United States Patent [19]

Kanda et al.

[11] Patent Number: 4,844,349

[45] Date of Patent: Jul. 4, 1989

[54] PROCESS FOR PRODUCING TONER FOR DEVELOPING ELECTROSTATIC IMAGES AND APPARATUS THEREFOR

[75] Inventors: Hitoshi Kanda, Yokohama; Masayoshi Kato, Kawasaki, both of Japan

[73] Assignee: Canon Kabushiki Kaisha, Tokyo, Japan

[21] Appl. No.: 108,681

[22] Filed: Oct. 15, 1987

[30] Foreign Application Priority Data

Oct. 17, 1986 [JP] Japan ..... 61-246610

[51] Int. Cl.[4] ..... B02C 19/12

[52] U.S. Cl. ..... 241/19; 241/23; 241/24; 241/39; 241/79.1; 241/80; 430/137

[58] Field of Search ..... 241/24, 29, 19, 79.1, 241/76, 77, 78, 80, 97, 5, 40, 39, 23; 430/137, 111, 121

[56] References Cited

U.S. PATENT DOCUMENTS 3,856,217 12/1974 Brewer ..... 241/79.1
4,284,701 8/1981 Abbott .
4,304,360 12/1981 Luhr et al. ..... 241/5
4,418,871 12/1983 Powell ..... 241/79.1 X
4,581,312 4/1986 Nakahara .

FOREIGN PATENT DOCUMENTS 0001785 5/1979 European Pat. Off. .
0168224 1/1986 European Pat. Off. .
2200721 7/1973 Fed. Rep. of Germany .
2914591 10/1979 Fed. Rep. of Germany .
3433191 3/1985 Fed. Rep. of Germany .
2021794 12/1979 United Kingdom .

*Primary Examiner*—Mark Rosenbaum
*Attorney, Agent, or Firm*—Fitzpatrick, Cella, Harper & Scinto

[57] ABSTRACT

A toner for producing electrostatic latent images is produced by classifying a pulverized feed material into a coarse powder and a fine powder in a first classifying means, pulverizing and recycling the coarse powder to the first classifying means, introducing the fine powder into a multi-division classifying chamber divided into at least three sections where the fine powder is classified into at least a coarse powder fraction, a medium powder fraction and a fine powder fraction. The medium powder fraction is recovered to provide a toner. The coarse powder fraction is recycled to the first classifying means.

24 Claims, 5 Drawing Sheets

PROCESS FOR PRODUCING TONER FOR DEVELOPING ELECTROSTATIC IMAGES AND APPARATUS THEREFOR

FIELD OF THE INVENTION AND RELATED ART

The present invention relates to a process and an apparatus for producing a toner having a predetermined particle size for developing electrostatic images, by effectively pulverizing and classifying solid particles containing a binder resin.

In image forming processes such as electrophotography, electrostatic photography and electrostatic printing, a toner is used to develop an electrostatic image.

For a process for producing a final product by pulverizing and classifying starting solid particles in the production of a toner for developing an electrostatic image in which the final product is required to be of very vine particles, in general, a process as shown in a flow chart of FIG. 6 is conventionally adopted. This process involves melt-kneading starting materials such as a binder resin and coloring agent (e.g., dye, pigment or magnetic material), cooling the kneaded mixture for solidification followed by pulverization of the solidified product, thereby obtaining pulverized solid particles as a pulverized product from the starting materials. The pulverized product is continuously or successively fed into first classifying means and classified therein, and the coarse powder consisting primarily of a group of the classified particles having a particle size greater than a defined range of sizes is fed into pulverizing means and pulverized therein, and then recycled to the first classifying means. The powder consisting primarily of other particles having particle sizes respectively falling within and smaller than the defined range is transferred to second classifying means and classified into a medium powder consisting primarily of a group of particles having a particle size within the defined range and a fine powder consisting primarily of a group of particles having a particle size smaller than the defined range.

For example, in order to provide a group of particles having a weight average particle size of 10 to 15 microns and containing 1 % or less of particles having a particle size smaller than 5 microns, a feed material is pulverized for classification in pulverizing means, such as an impact-type or jet-type pulverizer provided with a first classifying mechanism for removing a coarse powder until a predetermined average particle size is achieved, and the pulverized product free of the coarse powder removed is passed to another classifier to remove fine powder, thus providing a desired medium powder.

The weight average particle size used herein is an expression of the results of measurements, for example, by a Coulter counter available from Coulter Electronics, Inc. (U.S.A.). The weight-average particle size will be sometimes simply referred to as an "average particle size" hereinafter.

Such conventional processes are accompanied by the following problems. It is necessary to supply the second classifying means with particles substantially completely free of coarse particles having sizes exceeding a prescribed range, so that the pulverization means is subjected to a large load and the throughput thereof is lowered. In order to completely remove coarse particles exceeding a prescribed particle size range and not to have the coarse particles commingle into particles supplied to the second classifying means, some extent of excessive pulverization cannot be obviated. This leads to a problem that the yield of the medium powder having a desired particle size obtained through a subsequent second classifying means for removing fine powder is lowered.

In the second classifying means for removing fine powder, the aggregate constituted of extremely fine particles may be produced in some cases and are difficult to remove as fine powder. In such a case, the aggregate may be incorporated in a final product, resulting in a difficulty to produce a product having an exquisite distribution of particle sizes, while the aggregate may be broken in the resultant toner to form extremely fine particles, causing a degradation in quality of image. In the conventional processes, even if a desired product having an exquisite distribution of particle size could be obtained, unavoidable disadvantages are encountered such as complication of procedure, reduction in classifying yield and in efficiency of production, and increase in cost. The smaller the predetermined particle size, the more such tendency will be remarkable.

SUMMARY OF THE INVENTION

It is an object of the present invention to provide a process for producing a toner for developing electrostatic images, wherein the above mentioned various problems found in the prior art processes are overcome.

It is another object of the present invention to provide a process for effectively producing an electrostatic image-developing toner having an accurate distribution of particle sizes.

It is a further object of the present invention to provide a process for effectively producing an electrostatic image-developing toner having a good quality and smaller particle size (e.g., of 2 to 8 microns).

It is a yet further object of the present invention to provide a process for effectively producing a product of fine particles (for use as a toner) having an accurate distribution of particle sizes with a good yield from solid particles, as a feed material, which has been produced by melt-kneading a mixture comprising a binder resin, a coloring agent and various additives, cooling the kneaded mixture, and then pulverizing it.

According to the present invention, there is provided a process for producing a toner for developing electrostatic latent images, comprising:

melt-kneading a composition comprising at least a binder resin and a colorant, cooling and solidifying the kneaded product and pulverizing th solidified product to prepare a pulverize feed material;

introducing the pulverized feed material to a first classifying means to classify the feed material into a coarse powder and a fine powder;

introducing the classified coarse powder into a pulverization step and recycling the resultant pulverized product to the first classification means;

introducing the classified fine powder into a multi-division classifying chamber divided into at least three sections by partitioning means so that the particles of the fine powder are fallen along curved lines due to the Coanda effect, wherein a coarse powder fraction comprising primarily particles having a particle size above a prescribed range is collected in a first divided section, a medium powder fraction comprising primarily particles having a particle size within the prescribed range is collected in a second divided section, and a fine powder fraction comprising primarily particles having a particle size below the prescribed range is collected in a third divided section; and introducing the collected coarse powder fraction into the first classifying means together with the pulverized feed material.

According to another aspect of the present invention, there is provided an apparatus for producing such a toner, comprising: metering feeder means for metering and feeding a pulverized feed material for a toner, first classifying means for classifying the pulverized feed material into a fine powder and a coarse powder, pulverizing means for pulverizing the coarse powder classified in the first classifying means, introduction means for introducing the pulverized powder from the pulverizing means into the first classifying means, multi-division classifying means having a Coanda block for classifying the fine powder from the first classifying means into at least a coarse powder fraction, a medium powder fraction and a fine powder fraction through the Coanda effect, and introduction means for introducing the coarse powder fraction from the multi-division classifying means to the metering feeder means.

These and other objects, features and advantages of the present invention will become more apparent upon a consideration of the following description of the preferred embodiments of the present invention taken in conjunction with the accompanying drawings.

DETAILED DESCRIPTION OF PREFERRED EMBODIMENTS

Figure 1:
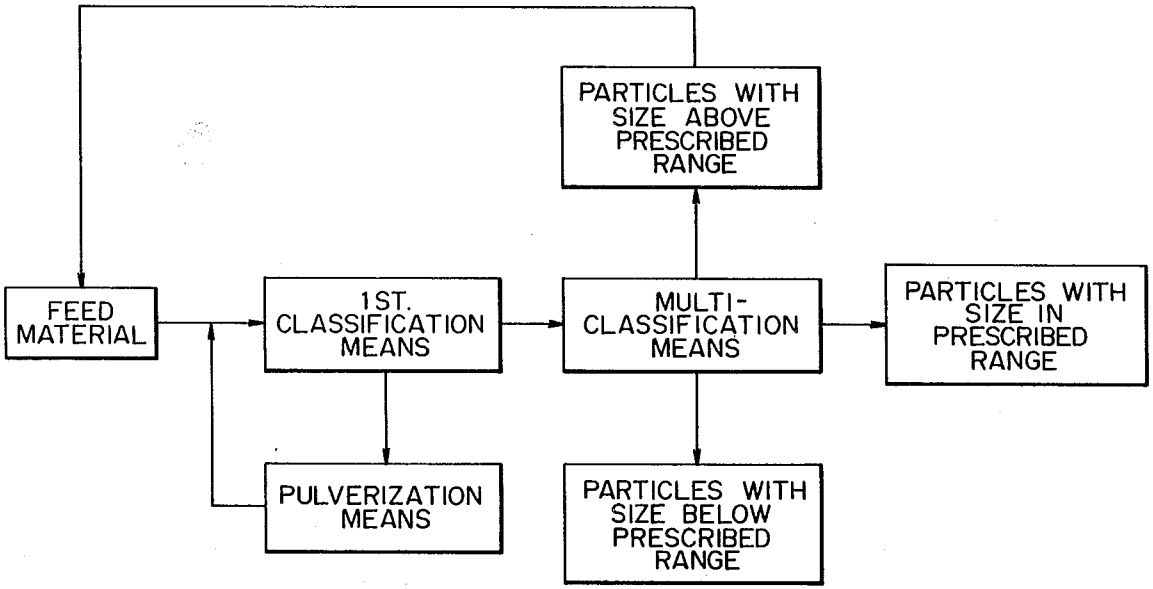
FIG. 1 is a block diagram of a process according to the present invention.
Figure 4:
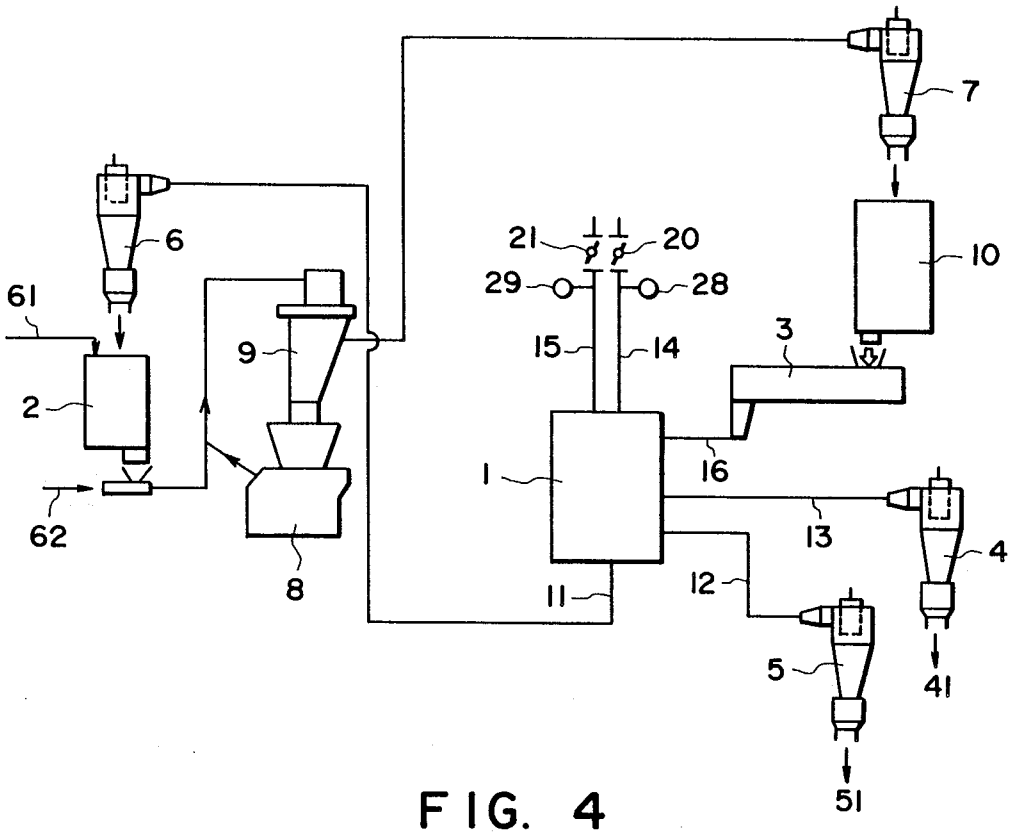
FIGS. 4 and 5 are respectively a schematic view illustrating a classification apparatus system for practicing the process according to the present invention.

In the process of the present invention, a pulverized material is used as a feed or raw material, and FIGS. 1 and 4 are a block diagram and a process flow chart illustrating an embodiment of the process. In the process, a feed material 61 is first supplied to a first classifying means having a function of removing a coarse particle region, and the classified coarse particles are fed to an appropriate pulverization means and after the pulverization recycled to the first classifying means. The feed particles from which the coarse particles have been removed are fed into a multi-division classification chamber or zone where they are classified into at least three particle size fractions: a larger particle size fraction (coarse powder consisting primarily of coarse particles), a medium particle size fraction (medium powder consisting primarily of particles having a particle size falling within a defined range) and a small particle size fraction (fine powder consisting primarily of particles having a particle size smaller than the defined range). The particles of the large particle size fraction are again introduced into the first classifying means together with the feed material and a coarse part thereof is pulverized by the pulverization means. On occasion, a part of the particles of the large particle size fraction can be recycled to a melting step in a process for producing the feed material.

The particles of the medium particle size fraction having a particle size within the defined range and the particles of the smaller particle size fraction having a particle size smaller than the defined range, are withdrawn from the multi-division classifying chamber by proper take-off means, respectively. The particles of the medium particle size fraction has a suitable distribution of particle sizes and can be used as a toner as they are. On the other hand, the particles of the smaller particle size fraction may be reutilized by recycling them to a melting step. It is preferred that the true specific gravity of the powder to be classified is about 0.5–2, particularly 0.6–1.7.

In order to obtain as the medium powder a product (toner powder) having a weight-average particle size of 11 $\mu$ (containing 0.5 wt. % of particles having a particle size of below 5.04 $\mu$ and a substantially negligible amount (less than 0.1 wt. %) of particles having a particle size of above 20.2 $\mu$), for example, it is preferred to effect pulverization so as to supply the multiple-division classification chamber with particles containing 15 wt. % or less, preferably 3–10 wt. %, having a particle size above 20.2 $\mu$ from the viewpoints of good pulverization efficiency and an increased classification efficiency.

Figure 3:
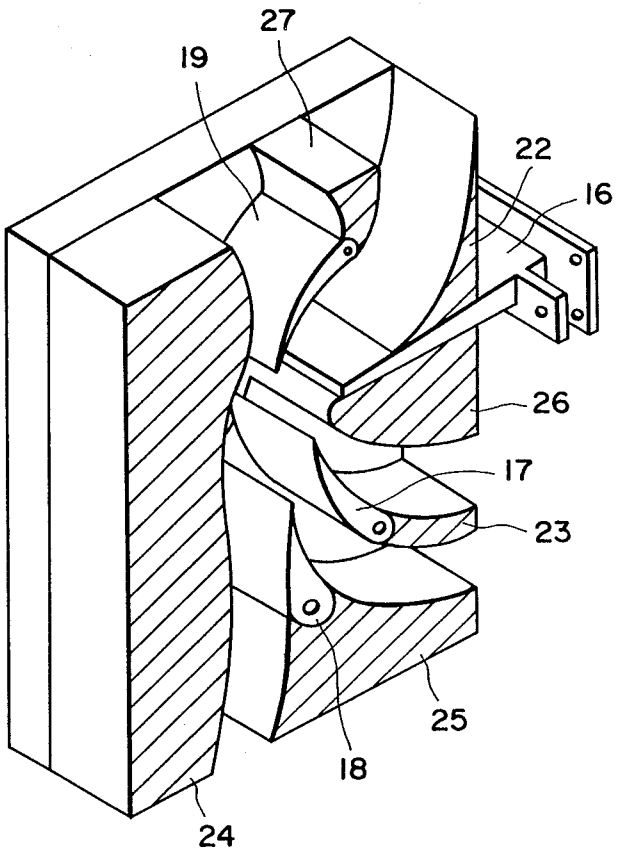
FIGS. 2 and 3 are a front sectional view and a sectional perspective view, respectively, of an apparatus embodiment for practicing multi-division classification according to the present invention.
Figure 2:
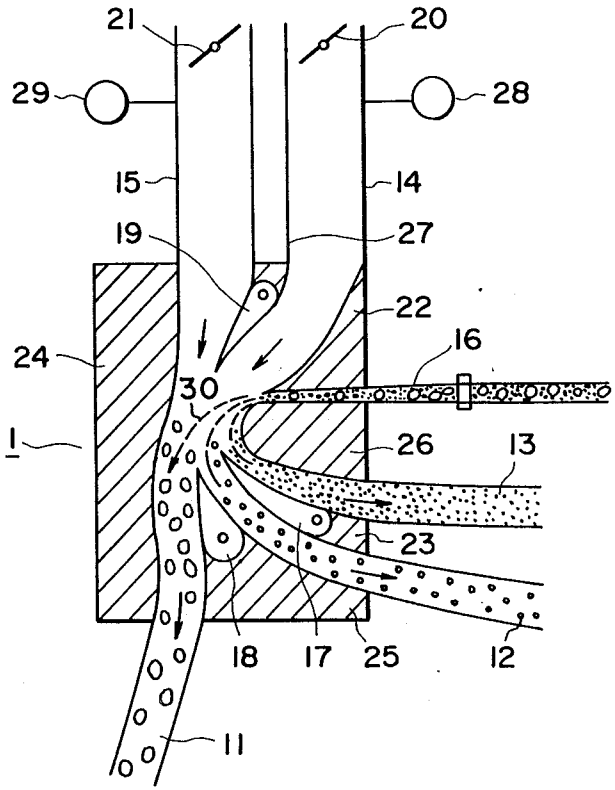

An embodiment for providing the above-mentioned multi-division classifying means may for example be a multi-division classifier as shown in FIG. 2 (sectional view) and FIG. 3 (perspective view). Referring to FIGS. 2 and 3, the classifier has side walls 22, 23 and 24, and a lower wall 25. The side wall 23 and the lower wall 25 are provided with knife edge-shaped classifying wedges 17 and 18, respectively, whereby the classifying chamber is divided into three sections. At a lower portion of the side wall 22, a fine powder supply nozzle 16 opening into the classifying chamber is provided. A Coanda block 26 is disposed along the lower tangential line of the nozzle 16 so as to form a long elliptic arc shaped by bending the tangential line downwardly. The classifying chamber has an upper wall 27 provided with a knife edge-shaped gas-intake wedge 19 extending downwardly. Above the classifying chamber, gas-intake pipes 14 and 15 opening into the classifying chamber are provided. In the intake pipes 14 and 15, a first gas introduction control means 20 and a second gas introduction control means 21, respectively, comprising, e.g., a damper, are provided; and also static pressure gauges 28 and 29 are disposed communicatively with the pipes 14 and 15, respectively. The locations of the classifying wedges 17, 18 and the gas-intake wafer 19 may vary depending on the kind of the feed material to be classified and the desired particle size. At the bottom of the classifying chamber, exhaust pipes 11, 12 and 13 having outlets are disposed corresponding to the respective classifying sections and opening into the chamber. The exhaust pipes 11, 12 and 13 can be respectively provided with shutter means like valve means.

The fine powder supply pipe 16 comprises a flat rectangular pipe section and a tapered rectangular pipe section, and it is preferred in order to obtain an appropriate introduction speed that the ratio between the internal size of the flat rectangular pipe section and the narrowest part of the tapered rectangular pipe section is 20:1 to 1.1:1, particularly 10:1 to 2:1.

A classifying operation is effected by using the above described multi-division classifying chamber or zone as follows. The classifying chamber is sucked or evacuated to a reduced pressure through at least one, preferably all, of the exhaust pipes 11, 12 and 13. A feed fine powder is supplied to the classifying chamber through the feed supply nozzle 16 along with a gas stream flowing at a high speed of 50–300 m/sec. At that time, the first gas stream introduction control means 20 and the second gas stream introduction control means 21 are preferably driven so that the absolute value of a static pressure (gauge pressure, i.e., a difference from the atmospheric pressure) $P_1$ at a position in the intake pipe 14 upstream of the inlet (downstream end of the pipe) opening into the classifying chamber is 150 mm.aq. or above, preferably 200 mm.aq. or above, further preferably 210 to 1000 mm.aq.; the absolute value of a static pressure $P_2$ (gauge pressure) at a position in the intake pipe 15 upstream of the inlet opening into the classifying chamber is 40 mm.aq. or above, preferably 45 to 400 mm.aq., further preferably 45 to 70 mm.aq.abs.; and the absolute values $|P_1|$ and $|P_2|$ satisfy the relation:

$$|P_1| - |P_2| \geqq 100 \text{ (mm.aq.)}.$$

This is preferred because the classification accuracy is increased thereby. The pressures are measured downstream of the gas stream control means 20 and 21.

When $|P_1| - |P_2| < 100$ (mm.aq.), there results in a tendency that the classification accuracy is lowered and it becomes impossible to accurately remove the fine powder fraction, so that the resultant classified product is caused to have a broad particle size distribution. The control of the static pressures $P_1$ and $P_2$ means the control of the flow rates of gaseous stream flowing through the intake pipes 14 and 15. When the fine powder is supplied to the classifying chamber at a rate below 50 m/sec, the aggregation of the fine powder cannot be sufficiently disintegrated, thus lowering the classification yield and the classification accuracy. When the fine powder is supplied to the classifying zone at a rate of above 300 m/sec, the toner particles can be pulverized because of collision therebetween to newly produce fine particles, thus tending to lower the classification accuracy.

The feed toner particles thus supplied are caused to fall along curved lines 30 due to the Coanda effect given by the Coanda block 26 and the action of the streams of a gas such as air, so that larger particles (coarse particles) fall along an outward gas stream to form a fraction outside (on the left side of) the classifying wedge 18, medium particles (particles having sizes in the prescribed range) form a fraction between the classifying wedges 18 and 17, and small particles (particles having sizes below the prescribed range) form a fraction inward (on the right side) of the classifying wedge 17. Then, the large particles, the medium particles and the small particles are withdrawn through the exhaust pipes 11, 12 and 13, respectively. The classifying conditions are preferably adjusted so that the particles classified into the second fraction region will have an average particle size of about 1–15$\mu$.

The above process may be generally operated by using a system in which the classifier is connected with other apparatus by communicating means such as pipes. A preferred embodiment of such an apparatus system is shown in FIG. 4. The apparatus system shown in FIG. 4 comprises a three-division classifier 1 as explained with reference to FIGS. 2 and 3, a metering feeder 2, a metering feeder 10, a vibration feeder 3, a collecting cyclone 4, a collecting cyclone 5, a collecting cyclone 6, a collecting cyclone 7, a a pulverizer 8 and a first classifier 9 connected through communication means.

In the above apparatus system, the feed material is supplied through the metering feeder 2 to the first classifier 9 where a coarse powder fraction is removed from fine powder. The fine powder is then supplied through the collecting cyclone 7 to the metering feeder 10, and then introduced through the vibration feeder 3 and the supply nozzle 16 into the three-division classifier 1 at a high speed. The coarse particles separated by the first classifier are supplied to the pulverizer 8, pulverized there and then introduced into the first classifier 9 together with a freshly charged feed material. For the purpose of introduction into the three-division classifier 1, the fine powder is introduced at a high speed of 50–300 m/sec under the action of a suction force exerted by the collecting cyclones 4, 5 and/or 6. Such introduction under the action of a suction force is preferred because less strict sealing of the apparatus system is acceptable As the size of the classifying zone or chamber in the classifier 1 is generally on the order of (10–50 cm)×(10–50 cm), the feed particles can be generally classified into three or more particle size fractions in a short period of 0.1 sec to 0.01 sec or less. In the three-division classifier 1, the feed toner material is divided into the large particles (coarse particles), the medium particles (particles with sizes in the prescribed range) and the small particles (particles with sizes below the prescribed range). The large particles are then sent through an exhaust pipe 11 and the collecting cyclone 6 to the metering feeder 2 containing the pulverized feed material 61.

The medium particles are withdrawn out of the system through an exhaust pipe 12 and collected by the collecting cyclone 5 to be recovered as a medium powder for providing a toner product. The small particles are withdrawn out of the system through an exhaust pipe 13 and collected by the collecting cyclone 4 to be recovered as minute powder 41 with sizes outside the prescribed range. The collecting cyclones 4, 5 and 6 function as suction and reduced pressure-generation means for introducing the feed material through the nozzle 16 into the classifying chamber.

For the pulverizer 3, pulverizing means such as an impact pulverizer or a jet pulverizer may be used. A commercially available embodiment of the impact pulverizer may be Turbomil mfd. by Turbo Kogyo K.K. and commercial available example of the jet pulverizer may include Supersonic Jet Mill PJM-I mfd. by Nihon Pneumatic Kogyo K.K. Furthermore, the multidivision classifier used in the present invention may be classifying means having a Coanda block for utilizing the Coanda effect including Elbow Jet mfd. by Nittetsu Kogyo K.K. as a commercially available example.

Figure 5:
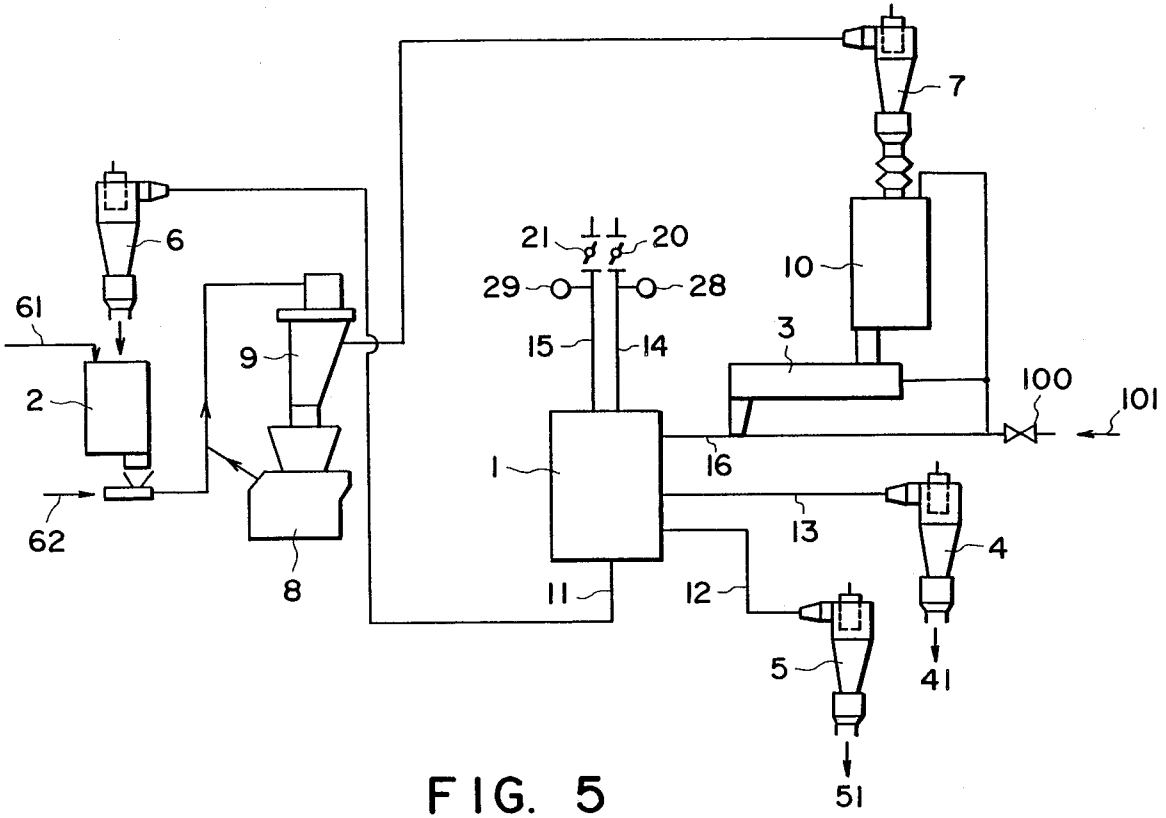

FIG. 5 shows an embodiment wherein a pressurized gas 101 is introduced through a shutter valve 100 to the nozzle 16. The pressurized gas 101 may be compressed air. In case where fine powder is introduced through a vibration feeder 3 under the action of the pressurized gas 101 into a three-division classifier 1, air-tightness of the respective stages and communication means connecting the stages is required.

In a pulverization-classification process wherein a conventional classifier having a purpose of removing only fine particles in the final classification step, it is required to completely remove coarse particles having sizes exceeding a prescribed particle size range from the feed powder having passed through the pulverization. In order not to allow coarse particles to flow into the final classification step, it is required to suppress the formation of coarse particles in the pulverization step. This leads to a tendency of over-pulverization and lowering in pulverization efficiency.

On the other hand, in the process of the present invention, coarse particles and fine particles outside a prescribed range are simultaneously removed by a specific multi-division classifying means. As a result, even if the feed particles having passed through pulverization contains a proportion of coarse particles having particle sizes exceeding a prescribed range, the coarse particles are removed substantially completely in the multi-division classifying mean in the subsequent step, so that the pulverization step is suffered from less restriction and allowed to utilize the capacity of the pulverizer to the maximum, thus resulting in good pulverization efficiency and less tendency of over-pulverization. As a result, the formation of fine powder is suppressed and aggregates of fine powder are disintegrated due to introduction at a high speed, so that the removal of fine powder is also accomplished very effectively to provide a well improved classification efficiency In the conventional classification step for separating a medium powder region and a fine powder region, it is liable that aggregates of fine particles causing fog in a developed image are formed as the residence time in the classification step is long. And, if aggregates are formed once, it is difficult to remove them from the medium powder region. In the process of the present invention, even if aggregates are commingled in the pulverized feed material, they are disintegrated because of the Coanda effect and/or impact accompanying high-speed movement to be fine powder for removal, and even if some aggregates remain, they are simultaneously removed as coarse particles. As a result, aggregates are effectively removed.

A toner for developing electrostatic images may be generally prepared by melt-kneading the starting materials including a binder resin such as a styrene type resin, a styrene-acrylic acid ester type resin or a polyester type resin; a colorant such as carbon black or phthalocyanine blue and/or a magnetic material; an antioffset agent such as low-molecular weight polyethylene or low-molecular weight polypropylene; and a positive or negative charge control agent, followed by cooling, pulverization and classification. Ordinarily, with respect to 100 wt. parts of a binder resin, 0.1 to 30 wt. parts of a colorant (or/and 20 to 150 wt. parts of a magnetic material), 0.5 to 10 wt. parts of an anti-offset agent and 0 to 5 wt. parts of a charge control agent may be used. In case where a colorant functioning also as a charge control agent is used, the colorant may preferably be used in an amount of 0.5 to 10 wt. parts.

In case where it is difficult to obtain a uniform melt dispersion of the starting materials in the kneading step, the pulverized particles can include particles which are not suitable as toner particles commingled therein, such as those free of a colorant or magnetic particle or comprising an individual particle of a single starting material. In the conventional process involving a long residence time in the classification stage such unsuitable particles are liable to aggregate with each other and it is difficult to remove the resultant aggregates, so that toner characteristics are remarkably impaired thereby. In contrast thereto, in the process of the invention, the feed particles after the first classification are introduced into a classification chamber at a high velocity and classified into three or more fractions instantaneously so that such aggregates are not readily formed, and even if formed, they can be disintegrated or removed into the coarse particle fraction. As a result, a classified product (used as a toner) comprising particles of a uniform mixture and having an accurate particle size distribution is obtained.

In the present invention, the pulverized feed material may preferably have a weight-average particle size of 10–200 μm, and the fine powder classified in the first classification step may preferably have a weight-average particle size of 3–30 μm. The coarse powder from the first classification step may preferably be pulverized to have a weight-average particle size of 7–100 μm. The classified fine powder may be further classified by the multi-division classifier into a coarse powder fraction having a weight-average particle size of 7–40 μm, a medium powder fraction having a weight-average particle size of 3–15 μm and a fine or minute powder fraction of a weight-average particle size of 10 μm or smaller. In this instance, it is preferred that the medium powder fraction has a weight-average particle size which is larger than that of the fine powder fraction by 1–7 μm and smaller than that of the large particle size by 2–30 μm. It is important to satisfy the above conditions in order to obtain high production efficiency and classification yield of toner powder.

A toner produced from the product powder of the process of the present invention has a stable triboelectric charge provided by friction between the toner particles, and between the toner and a toner carrying member such as a sleeve or carrier. Development fog and scattering of toner around the edge of a latent image, which have not been fully solved heretofore, are extremely reduced, and a high density of image is achieved, leading to a good reproducibility of half tone. Even in the continuous use of a developer including the toner over a long period, an initial performance can be maintained and quality images can be provided over a long period. Further, even in the use of the toner under environmental conditions of a high temperature and a high humidity, the triboelectric charge of the developer is stable and little vary a compared with that when used under normal temperature and normal humidity, because the presence of extremely fine particles and the aggregate thereof are reduced. Therefore, the fog and decrease in density of image are reduced, enabling the development of images faithful to latent images. Moreover, the resulting toner images have an excellent transfer efficiency to a transfer material such as a paper. Even in the use of the toner under the conditions of a low temperature and a low humidity, a distribution of triboelectric charge is little different from that in the use at normal temperature and normal humidity, and because the extremely fine particle component having an extremely large charge per unit weight has been removed, the toner produced by the process of the present invention has such characteristics that there occur little reduction in density of image and little fog, and roughening and scattering during transfer hardly occur.

In producing a toner powder having a smaller particle size (e.g., an average particle size of 3 to 7 μ), the process of the present invention can be carried out more effectively than the prior art process is.

The present invention will now be described in detail by way of Examples.

| | |
|---|---|
| Styrene-acrylic acid ester resin (weight ratio of styrene to the acrylic ester 7:3, weight-average molecular weight of about 300,000) | 100 wt. parts |
| Magnetite (particle size: about 0.2μ) | 60 wt. parts |
| Low molecular weight polyethylene (weight-average molecular weight of about 3,000) | 2 wt. parts |
| Negatively chargeable control agent (Bontrone E81) | 2 wt. parts |

A toner feed material of a mixture having the above prescription was melt-kneaded at 180° C. for about 1.0 hour, and cooled for solidification. The resulting mixture was roughly pulverized into particles of 100 to 1,000 um in a hammer mill and then moderately pulverized into a weight-average particle size of 100 μm in a mechanical pulverizer (ACM Pulverizer available from Hosokawa Micron K.K.). The true density of the pulverized material 61 thus obtained was about 1.4. The pulverized material 61 was charged in a metering feeder 2 and introduced at a rate of 1.3 kg/min into a first fixed wall-type gas stream classifier (Gas-Stream Classifier DS-10 VR mfd. by Nippon Pneumatic Kogyo K.K.). The coarse powder from the classifier was pulverized by a jet mill pulverizer (Hypersonic Jet Mill PJM-I-10, mfd. by Nippon Pneumatic Kogyo K.K.) and then recycled to the first classifier. The particle size distribution of the fine powder classified from the first classifier was measured whereby the fine powder was found to have a weight average particle size of about 12.5 μ (containing 5.5 wt. % of particles having a particle size below 5.04 μ and 8.2 wt. % of particles having a particle size of above 20.2 μ). The thus obtained fine powder was charged in a metering feeder 10 and introduced through a vibration feeder 3 at a rate of 1.3 kg/min into a multi-division classifier 1 as shown in FIGS. 2 and 3 for classification into three fractions of a coarse powder fraction, a medium powder fraction and a fine powder fraction by utilizing the Coanda effect. As the multi-division classifier utilizing the Coanda effect, Elbow Jet EJ-45-3 available from Nittetsu Kogyo K.K. was used.

For effecting the introduction, the collecting cyclones 4, 5 and 6 communicated with the exhaust pipes 11, 12 and 13 were operated to generate a reduced pressure in the classification chamber, by which the pulverized material was introduced at a velocity of about 100 m/sec through the supply nozzle 16. At this time, the static pressure $P_1$ in the intake pipe 14 at a point upstream of the inlet to the chamber was controlled at −290 mm.aq., i.e. −290 mm $H_2O$ (gauge), and the static pressure $P_2$ in the intake pipe 15 was controlled at −70 mm.aq. The introduced fine powder was classified in an instant of 0.01 second or less. A medium powder suitable as a toner was collected in a yield of 85 wt. % in the collecting cyclone 5 for collecting the classified medium powder, and had a weight-average particle size of 11.5 μ (containing 0.3 wt. % of particles having a particle size of below 5.04 μ and 0.1 wt. % or less, i.e., a substantially negligible amount, of particles having a particle size of above 20.2 μ). As used herein, the term "yield" refers to a percentage of the amount of the medium powder finally obtained based on the total weight of the pulverized feed material. Substantially no aggregate of about 5 μ or larger resulting from the aggregation of extremely fine particles was found by the observation of the obtained medium powder through an optical microscope.

The classified coarse powder fraction was collected by the collecting cyclone 6 and then supplied to the metering feeder 2.

The obtained medium powder was electrically insulating. The medium powder was used as a toner, and 0.3 % by weight of hydrophobic silica was mixed with the toner to prepare a developer. The prepared developer was supplied to a copier NP-270 RE (available from Canon K.K.) to effect a copying test. The results showed that copied images having no fog and a good developing property for thin lines were provided.

COMPARATIVE EXAMPLE 1

Figure 6:
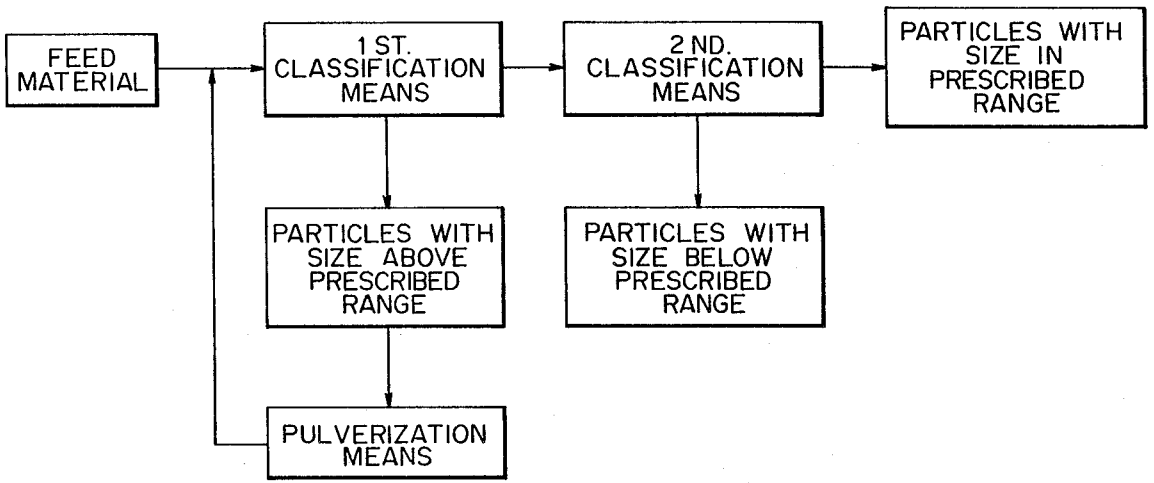
FIG. 6 PRIOR ART
FIG. 6 is a flow chart of a prior art process.

A pulverized material produced in the same manner as in Example 1 was, introduced at a rate of 2.0 kg/min and classified in an apparatus system as shown in FIG. 6.

The pulverized feed material having a weight average particle size of 100 μ was introduced into a first fixed wall-type gas stream classifier (Gas-Stream Classifier DS-10 VR mfd. by Nippon Pneumatic Kogyo K.K.). The coarse powder from the classifier was pulverized by a jet mill pulverizer (Hypersonic Jet Mill PJM-I-10, mfd. by Nippon Pneumatic Kogyo K.K.) and then recycled to the first classifier. The particle size distribution of the fine powder classified from the first classifier was measured whereby the fine powder was found to have a weight-average particle size of about 9.6 μ (containing 10.0 wt. % of particles having a particle size below 5.04 μ and 0.5 wt. % of particles having a particle size of above 20.2 μ). The thus obtained fine powder was introduced to a second gas stream classifier (DS-10 VR) to be classified into a medium powder and a fine powder.

The medium powder had a weight-average particle size of about 11.6 μ and was obtained at a classification yield of 70 wt. %. The observation of the medium powder through an optical microscope showed that aggregate of about 5 μ or more was present in dots, resulting from the aggregation of the extremely fine particles. The production efficiency was also inferior compared with Example 1.

The resultant medium powder was used as a toner, and 0.3 % by weight of hydrophobic silica was mixed with the toner to prepare a developer. The prepared developer was supplied to a copier NP-270RE to effect a copying test. The results showed that the duplicated images had increased fog as compared with those obtained in Example 1.

When a fine powder containing about 8 wt. % of particles having a particle size of above 20.2 μ was introduced to the second classifier, the resultant classified medium powder contained many coarse particles and could not be a practical toner product.

EXAMPLES 2–4

Example 1 was repeated by changing the respective conditions as shown in the following tables together with those in Example 1.

| | [Pulverized feed material] | |
|---|---|---|
| | Feed material | |
| Example | Average particle size (μ) | True density |
| 1 | 100 | 1.4 |
| 2 | 80 | 1.4 |

-continued

| Example | [Pulverized feed material] Feed material: Average particle size (μ) | True density |
|---|---|---|
| 3 | 50 | 1.4 |
| 4 | 30 | 1.5*[1] |

*[1]The amount of magnetite was increased to 80 wt. parts per 100 wt. parts of the binder resin.

| Example | [First Classification step] Feed rate (kg/min) | Fine powder after the first classification: Wt. average particle size (μ) | Content of below 5.04μ (wt. %) | Content of above 20.2μ (wt. %) |
|---|---|---|---|---|
| 1 | 1.3 | 12.5 | 5.5 | 8.2 |
| 2 | 1.5 | 12.3 | 5.5 | 7.5 |
| 3 | 1.6 | 12.1 | 5.5 | 6.3 |
| 4 | 2.0 | 9.5 | 11.0 | 2.0 |

| Example | [Pulverization step] Wt. average particle size of the pulverized product (μ) |
|---|---|
| 1 | about 30 |
| 2 | about 27 |
| 3 | about 20 |
| 4 | about 15 |

| Example | [Multi-division classification step] (residence time: 0.1-0.01 sec) Fine powder: charge rate (kg/min) | charge velocity (m/sec) | Static pressure (mm.aq. gage): $P_1$ | $P_2$ |
|---|---|---|---|---|
| 1 | 1.3 | 100 | −290 | −70 |
| 2 | 1.5 | 100 | −295 | −70 |
| 3 | 1.6 | 95 | −300 | −70 |
| 4 | 2.0 | 120 | −350 | −70 |

| Example | [Classification product from multi-division classifier] Medium powder: Ave. size (μ) | Content of below 5.04μ (wt. %) | Content of above 20.2μ (wt. %) | Aggregate of above 5μ | Yield (wt. %) | Size (μ): Coarse powder | Fine powder |
|---|---|---|---|---|---|---|---|
| 1 | 11.5 | 0.3 | <0.1 | substantially no | about 85 | 25 | 7 |
| 2 | 11.0 | 0.3 | <0.1 | substantially no | about 83 | 24 | 7 |
| 3 | 11.0 | 0.3 | <0.1 | substantially no | about 82 | 24 | 7 |
| 4 | 11.0 | 0.6 | <0.1 | substantially no | about 85 | 16 | 6 |

COMPARATIVE EXAMPLES 2-4

Comparative Example 1 was repeated by changing the respective conditions as shown in the following tables together with those in Comparative Example 1.

| | [Pulverized feed material] Feed material: Ave. size (μ) | Time density | Remarks |
|---|---|---|---|
| Comparative Example 1 | 100 | 1.4 | The same as in Example 1 |
| Comparative Example 2 | 80 | 1.4 | The same as in Example 2 |
| Comparative Example 3 | 50 | 1.4 | The same as in Example 3 |
| Comparative Example 4 | 30 | 1.5 | The same as in Example 4 |

| | [First classification step] Feed rate (kg/min) | Fine powder after the first classification: Wt. ave. particle size (μ) | Content of below 5.04μ (wt. %) | Content of above 20.2μ (wt. %) |
|---|---|---|---|---|
| Comparative Example 1 | 1.0* | 9.6 | 10 | 0.5 |
| Comparative Example 2 | 1.1 | 9.6 | 10 | 0.5 |
| Comparative Example 3 | 1.3 | 9.6 | 10 | 0.5 |
| Comparative Example 4 | 1.5 | 8.5 | 13 | 0.2 |

*Note: In order to obtain a medium powder having a particle size substantially similar to that obtained in Examples, it was necessary to reduce the feed rate.

| | [Pulverization step] Wt. average particle size of the pulverized product (μ) |
|---|---|
| Comparative Example 1 | about 27* |
| Comparative Example 2 | about 25 |
| Comparative Example 3 | about 18 |
| Comparative Example 4 | about 14 |

*Note: In order to prevent coarse particles from commingle into the feed to the second classification step, it was necessary to increase the intensity of pulverization.

| | [Second classification step] (Feed speed: about 30 m/sec, Residence time: about 20 sec) | | | | |
|---|---|---|---|---|---|
| | Product | | | | |
| | Medium powder | | | | Fine powder |
| | Wt. average size (μ) | Content of below 5.04μ (wt. %) | Content of above 20.2μ (wt. %) | Aggregate of above 5μ | Wt. average size (μ) |
| Comparative Example 1 | 11.6 | 0.4 | 2 | observed | 6.5 |
| Comparative Example 2 | 11.2 | 0.4 | 2 | " | 6.5 |
| Comparative Example 3 | 11.2 | 0.4 | 2 | " | 6.5 |
| Comparative Example 4 | 10.3 | 0.7 | 1 | " | 6.5 |

The classification yields of the medium powders and developing characteristic of the toners obtained therefrom in the respective Examples and Comparative Examples are summarized in the following Table.

| | Classification yeild (%) | Developing characteristics* | |
|---|---|---|---|
| | | Fog | Reproducibility of thin lines |
| Example | | | |
| 1 | about 85 | o | o |
| 2 | about 83 | o | o |
| 3 | about 82 | o | o |
| 4 | about 85 | o | o |
| Comparative Example | | | |
| 1 | about 70 | Δ | Δ |
| 2 | about 68 | Δ | Δ |
| 3 | about 67 | Δ | Δ |
| 4 | about 70 | x | x |

*Note: The evaluation standards were as follows:
o: Very good
Δ: Good
x: Somewhat poor

What is claimed is:

1. A process of producing toner particles for developing electrostatic latent images, comprising:

melt-kneading a composition comprising at least a binder resin and a colorant, cooling and solidifying the kneaded product and pulverizing the solidified product to prepare a pulverized feed material;

introducing the pulverized feed material to a first classifying means to classify the feed material into a coarse powder and a fine powder;

introducing the classified coarse powder into a pulverization step and recycling the resultant pulverized product to the first classification means;

introducing the classified fine powder through a supply nozzle into a multi-division classifying chamber divided into at least three sections by partitioning means so that the particles of the fine powder fall along curved lines due to the Coanda effect, wherein a coarse powder fraction comprising primarily particles having a particle size above a prescribed range is collected in a first divided section, a medium powder fraction comprising primarily particles having a particle size within the prescribed range is collected in a second divided section, and a fine powder fraction comprising primarily particles having a particle size below the prescribed range is collected in a third divided section, wherein the first divided section is located farther than the second divided section and the second divided section is located farther than the third divided section, respectively, with respect to the supply nozzle; and introducing the collected coarse powder fraction into the first classifying means together with the pulverized feed material.

2. A process according to claim 1, wherein the fine powder is introduced into the multi-division classification chamber at a speed of 50–300 m/sec.

3. A process according to claim 1, wherein the fine powder is introduced by suction into the multi-division classification chamber.

4. A process according to claim 1, wherein the first classifying means comprises a fixed wall-type gas stream classifier.

5. A process according to claim 1, wherein the fine powder is introduced into the multi-division classification chamber formed in a multi-division classifier having a Coanda block.

6. A process according to claim 5, wherein the fine powder fraction is introduced by suction into the multi-division classification chamber at a speed of 50 to 300 m/sec.

7. A process according to claim 1, wherein the pulverized feed material has a weight-average particle size of 10 to 200 μm.

8. A process according to claim 7, wherein the classified fine powder is classified in the multidivision classification chamber into the coarse powder fraction having a weight-average particle size of 7 to 40 μm, the medium powder fraction having a weight-average particle size of 3 to 15 μm and the fine powder fraction having a weight-average particle size of 10 μm or smaller, in which the weight-average particle size of the medium powder fraction is larger by 1 to 7 μm than that of the fine powder fraction and smaller by 2 to 30 μm than that of the coarse powder fraction.

9. A process according to claim 1, wherein pulverized feed material is classified into the coarse powder and the fine powder having a weight average particle size of 3 to 30 μm by the first classifying means.

10. A process according to claim 9, wherein the classified coarse powder is pulverized in the pulverized step to a powder having a weight-average particle size of 7 to 100 μm.

11. A process according to claim 1, wherein the pulverized feed material has a true density of 0.5 to 2.

12. A process according to claim 1, wherein the pulverized feed material has a true density of 0.6 to 1.7.

13. A process according to claim 1, wherein the fine powder is classified into the coarse powder fraction, the medium powder fraction and the fine powder fraction in the multi-division classification chamber in a period of 0.1 sec or less.

14. A process according to claim 1, wherein the pulverized feed material is obtained through the melt-kneading, cooling and pulverization of the composition comprising 100 wt. parts of the binder resin, 0.1 to 30 wt. parts of the colorant, 0.5 to 10 wt. parts of an anti-offset agent, and 0 to 5 wt. parts of a charge control agent.

15. A process according to claim 14, wherein the binder resin is a thermoplastic resin selected from the group consisting of styrene-type resin, styrene-acrylic acid ester-type resin, styrene-methacrylic acid ester-type resin, and polyester-type resin.

16. A process according to claim 1, wherein the puvlerized feed material is obtained through the melt-kneading, cooling and pulverization of the composition comprising 100 wt. parts of the binder resin, 20 to 150 wt. parts of a magnetic material, 0.5 to 10 wt. parts of an anti-offset agent, and 0 to 5 wt. parts of a charge control agent.

17. A process according to claim 16, wherein the binder resin is a thermoplastic resin selected from the group consisting of styrene-type resin, styrene-acrylic acid ester-type resin, styrene-methacrylic acid ester-type resin, and polyester-type resin.

18. An apparatus for producing a toner for developing electrostatic latent images, comprising:

metering feeder means for metering and feeding a pulverized feed material for a toner, first classifying means for classifying the pulverized feed material into a fine powder and a coarse powder, pulverizing means for pulverizing the coarse powder classified in the first classifying means, introduction means for introducing the pulverized powder from the pulverizing means through a supply nozzle into the first classifying means, multi-division classifying means having a Coanada block for classifying the fine powder from the first classifying means into at least a coarse powder fraction, a medium powder fraction and a fine powder fraction through the Coanda effect so that the coarse powder fraction is collected in a first divided section, the medium powder fraction is collected in a second divided section and the fined powder fraction is collected in a third divided section wherein the first divided section is located farther than the second divided section and the second divided section is located farther than the third divided section, respectively, with respect to the supply nozzle, and introduction means for introducing the coarse powder fraction from the multi-division classifying means to the metering feeder means.

19. An apparatus according to claim 18, wherein the pulverizing means comprises an impact-type classifier or a jet-type classifier.

20. An apparatus according to claim 18, wherein said multi-division classifying means has exhaust pipes for withdrawing the classified coarse powder fraction, medium powder fraction and fine powder fraction, respectively.

21. An apparatus according to claim 20, wherein said multi-division classifying means is communicative with collecting cyclones through the exhaust pipes.

22. An apparatus according to claim 18, wherein said multi-division classifying means has at least two intake pipes for introducing a gas to the classifying zone.

23. An apparatus according to claim 22, wherein the intake pipes respectively have gas introduction control means for controlling the rate of gas passing through the pipes.

24. An apparatus according to claim 18, wherein said multi-division classifying means has a supply nozzle for introducing the fine powder into the classification chamber, the supply nozzle comprising a flat rectangular pipe section and a tapered rectangular pipe section.

* * * * *

UNITED STATES PATENT AND TRADEMARK OFFICE

CERTIFICATE OF CORRECTION

PATENT NO. : 4,844,349

DATED : July 4, 1989

INVENTOR(S) : Kanda et al.

It is certified that error appears in the above-identified patent and that said Letters Patent is hereby corrected as shown below:

COLUMN 2:

Line 51, "th" should read --the--.

COLUMN 6:

Line 45, "pulverizer 3," should read --pulverizer 8--.

COLUMN 7:

Lines 53 and 56, "In case" should read --In a case--.

COLUMN 8:

Line 44, "vary a" should read --vary as--.

COLUMN 9:

Line 32, "weight average" should read --weight-average--.

COLUMN 10:

Line 20, "weight aver-" should read --weight-aver- --.

UNITED STATES PATENT AND TRADEMARK OFFICE

CERTIFICATE OF CORRECTION

PATENT NO. : 4,844,349

DATED : July 4, 1989

INVENTOR(S) : Kanda et al.

It is certified that error appears in the above-identified patent and that said Letters Patent is hereby corrected as shown below:

COLUMN 16:

Line 6, "fined" should read --fine--.

Lines 16 and 17, "classifier" should read --pulverizer--.

Signed and Sealed this

Nineteenth Day of June, 1990

*Attest:*

*Attesting Officer*

HARRY F. MANBECK, JR.

*Commissioner of Patents and Trademarks*